US006381338B1

(12) United States Patent
Ou

(10) Patent No.: US 6,381,338 B1
(45) Date of Patent: Apr. 30, 2002

(54) ALL DIRECTIONALLY TURNABLE RADIO MICROPHONE

(76) Inventor: Jack Ou, 3Fl., No. 12, Lane 47, Fu-Kang St., Nan-Kang District, Taipei City (TW)

( * ) Notice: Subject to any disclaimer, the term of this patent is extended or adjusted under 35 U.S.C. 154(b) by 0 days.

(21) Appl. No.: 09/828,781

(22) Filed: Apr. 10, 2001

(51) Int. Cl.[7] ..... H04R 25/00
(52) U.S. Cl. ..... 381/365; 381/361
(58) Field of Search ..... 381/355, 360, 381/361, 364, 365, 366; 455/569, 99, 550; 379/431, 433.03, 433.11

(56) References Cited

U.S. PATENT DOCUMENTS 4,040,547 A * 8/1977 Dickey ..... 381/364
4,811,405 A * 3/1989 Peiker ..... 381/365

* cited by examiner

*Primary Examiner*—Huyen Le
(74) *Attorney, Agent, or Firm*—Rosenberg, Klein & Lee

(57) ABSTRACT

A radio microphone to be incorporated in a cellular phone handfree kit well-suited for using in a vehicle is composed of a main clip, an auxiliary clip a rotatable base, and a microphone main body, it is an all directionally turnable and handy communication device made up with low cost.

4 Claims, 5 Drawing Sheets

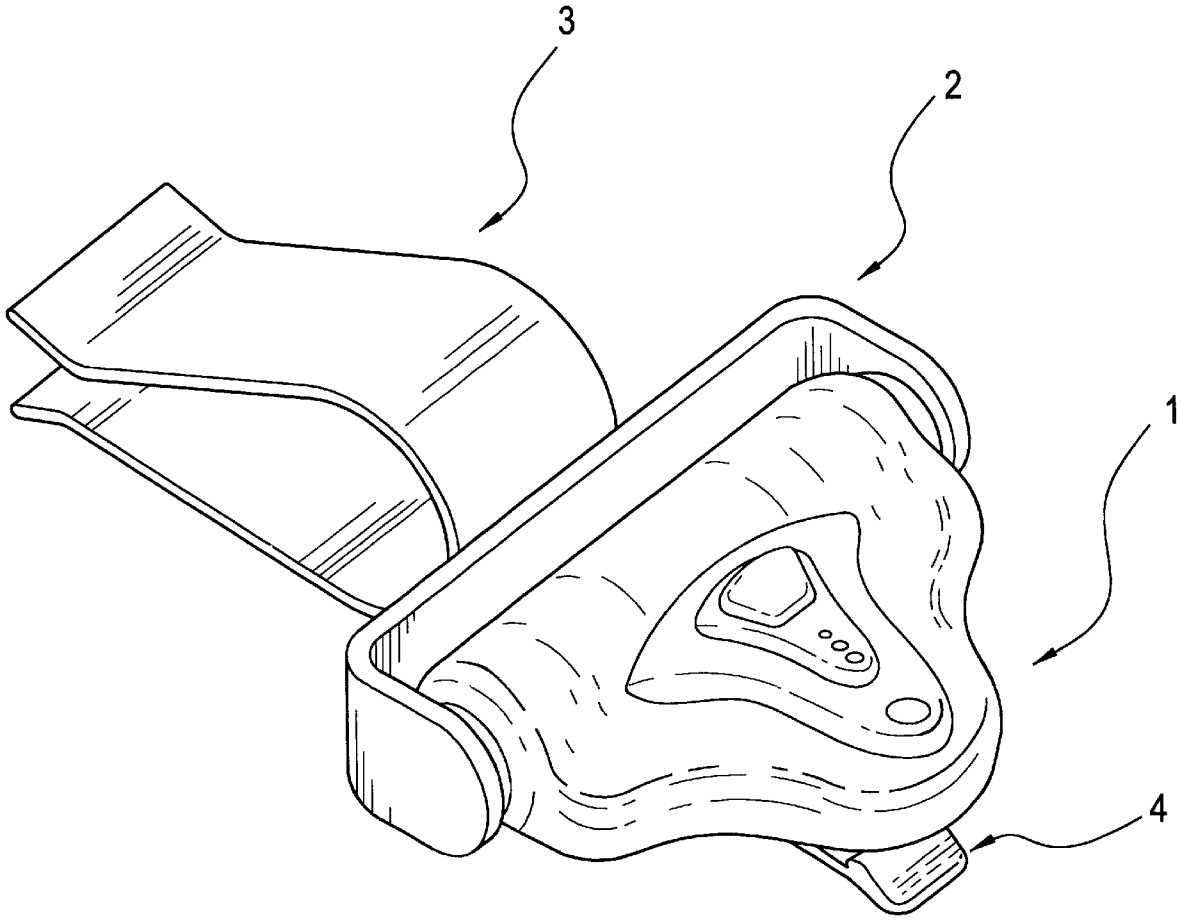
FIG.2( A )

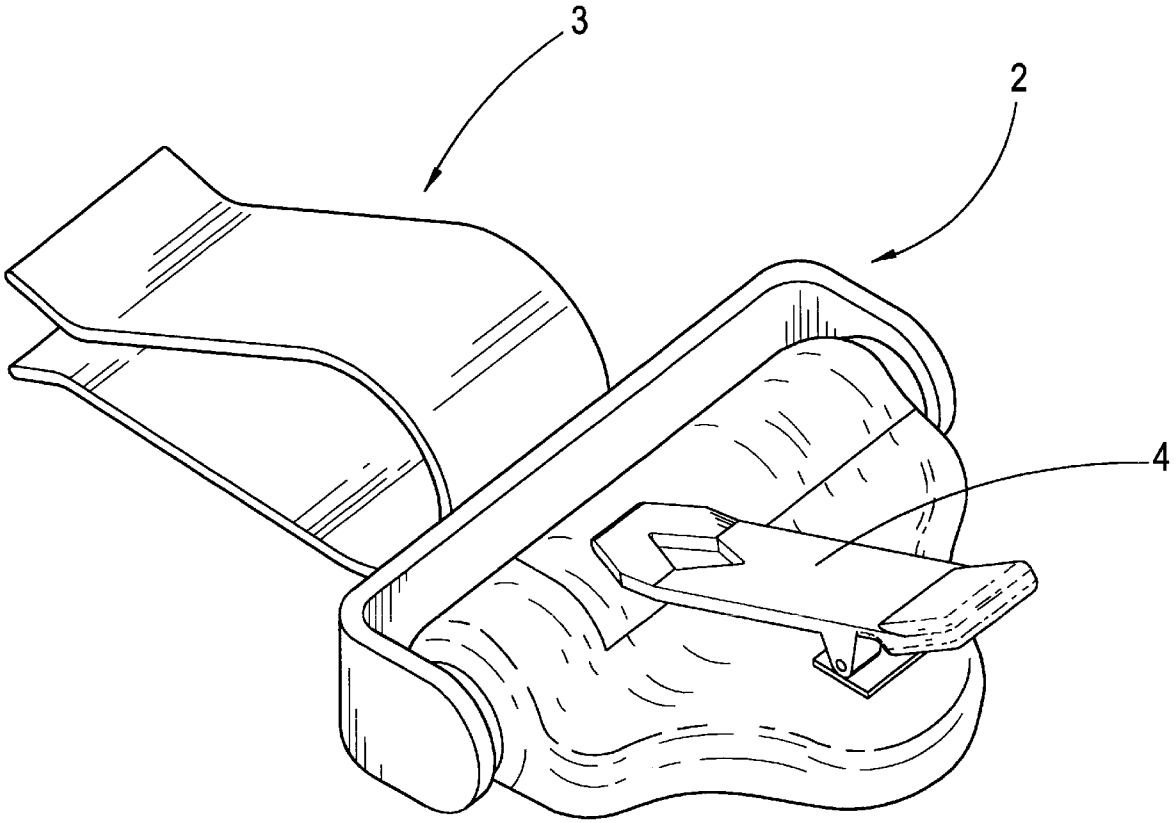
FIG.2 ( B )

ALL DIRECTIONALLY TURNABLE RADIO MICROPHONE

BACKGROUND OF THE INVENTION

1. Field of the Invention

The present invention relates to a radio microphone, and particularly to an all directionally turnable radio microphone to be incorporated in a handfree kit for cellular phone well-suited for using in a vehicle.

2. Description of the Prior Art

With a common handfree cellular phone, the driver can easily and conveniently make a phone call in the vehicle without the worry of a traffic accident. But for installing such an additional handfree cellular phone kit in the limited interior spacing, some of vehicle owner's favorite equipment or ornamentation has to be spared for it. Besides, an extra cost needed for installing a handfree cellular phone kit in an old vehicle is often pretty high, and the maintenance cost which is sure to follow is unnegligible too.

In using the handfree cellular phone in the vehicle, people always worry about quality of conversation, especially about whether what they say is clearly understandable by the other side. Further, those cord conductors for connecting components parts of the cellular phone kit meandering around in the narrow car spacing is another annoying problem.

In order to solve the above described problems, the present inventor carried out theoretical studies and simulating experiments. Based on these studies and researches, the present inventor came to propose the present invention.

SUMMARY OF THE INVENTION

It is an object of the present invention to provide an all directionally turnable radio microphone to be incorporated in a cellular phone handkit well-suited for using in a vehicle.

It is another object of the present invention to provide an all directionally turnable radio microphone which is well isolated from interference of the receiver unit and miscellaneous foreign signals to ensure excellent communication quality.

It is still another object of the present invention to provide a vehicle radio microphone which is easy to be installed/removed, and manufactured with low cost.

To achieve these and other objects described above, the radio microphone of the present invention comprises a main body, a rotatable base, a main clip, and an auxiliary clip. Two elastic straps formed at both sides of the rotatable base are coupled with two female recesses formed at both sides of the main body such that the main body is relevantly grasped by the rotatable base and turnable 180° up and down about an axis connecting two male protrusions of the elastic straps. The main clip having a containment hole is conjoined with a rotating shaft of the rotatable base such that the main body is rotatable 360° by the rotating shaft of the rotatable base. With this construction, the main body of the microphone can be clipped onto the sunshade in the front window of the vehicle with the main clip, or clipped onto the driver's or other person's clothing with the auxiliary clip so that the radio microphone can be conveniently used.

BRIEF DESCRIPTION OF THE DRAWINGS

To enable a further understanding of the innovative and technological content of the invention herein, refer to the detailed description of the invention and the accompanying brief description of the drawings appended below.

FIG. 2A is a three dimensional exploded view of the present invention.

FIG. 2B is a view showing that the main body of the microphone is rotated 180° from the position of FIG. 2A.

DETAILED DESCRIPTION OF THE PREFERRED EMBODIMENT

Figure 1:
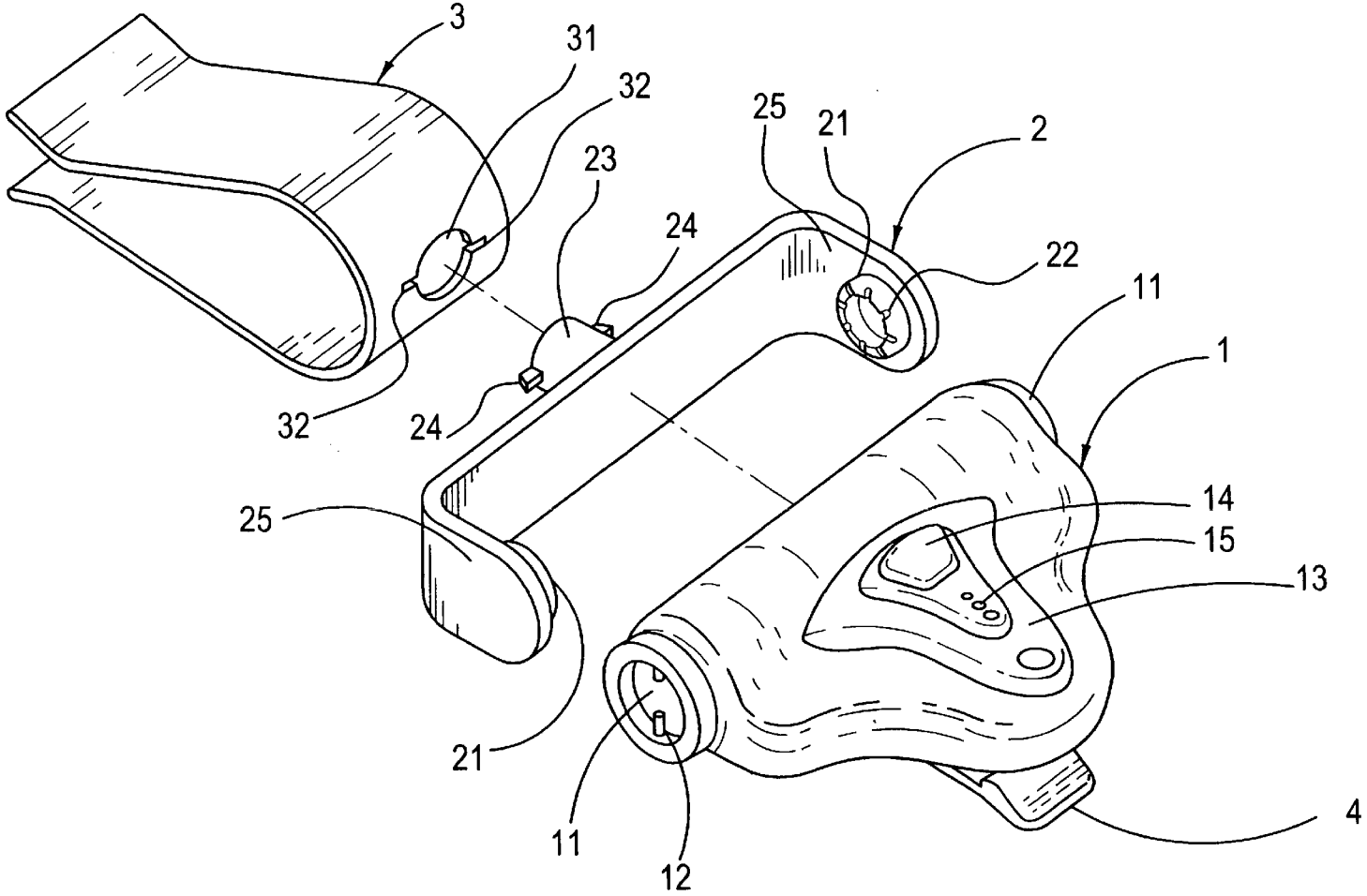
FIG. 1 is a three dimensional exploded view of the present invention.

Referring to FIGS. 1, 2A and 2B simultaneously, the radio microphone of the present invention comprises a main clip 3 having a containment hole 31 with two opposing trap slots 32 stretched radially out of its circumference; a rotatable base 2 with a rotating shaft 23 attached to its center and has two elastic straps 25 erected vertically at its both ends thereof and the inner surfaces of both elastic straps 25 are formed into male protrusions 21 each provided with several notches 22 equidistantly disposed around its circumference, the front end of rotating shaft 23 is provided with two radially emerged stoppers 24; and a microphone main body 1 having a female recess 11 at each of its both sides each of which being provided with two inwardly emerged protuberances 12.

With this construction, the rotating shaft 23 of the rotatable base 2 is inserted into the containment hole 31 of the main clip 3 with the two stoppers 24 on the shaft 23 trapped in the two trap slots 32 stretched out of the containment hole 31 such that the shaft 23 is able to rotate the rotatable base 2 by 360° on the main clip 31. On the other hand, the microphone main body 1 is conjoined with the rotatable base 2 by its female recesses 11 coupled to the male protrusions 21 such that the main body 1 is secured to the rotatable base 2 by the resilient force provided by two elastic straps 25 of the rotatable base 2 thereby the microphone main body 1 is turnable 180° up and down about an axis connecting the center of the two male protrusions 21. During turning, the main body 1 can be halt at a position where the protuberances 12 of the female recesses 11 are mated with any pair of notches 22 of the male protrusion 21 thereby the microphone main body 1 can be positioned at a desired direction convenient for the user.

As shown in FIG. 1, the microphone main body 1 is provided with a control board 13 with a push button switch 14, a microphone 15, and a light emission diode(LED) all equipped thereon.

In the present invention, an auxiliary clip 4 is provided to clip the microphone main body 1 onto the user's clothing for the sake of convenience.

Furthermore, a round is formed at the front tip of the stopper 24 of the rotating shaft 23 so as to facilitate insertion of the stopper 24 into the trap slot 32 of the containment hole 31.

Figure 3:
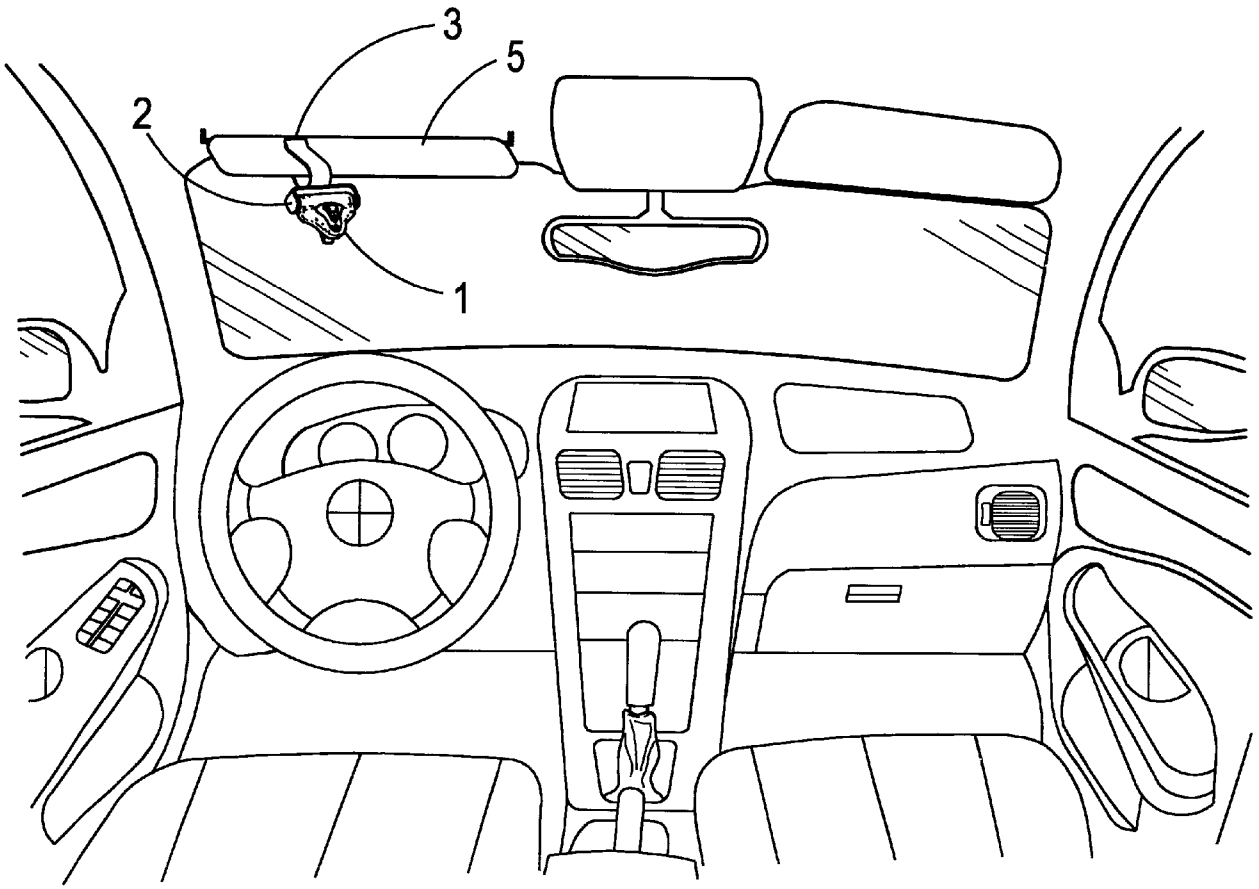
FIG. 3 is a view of the microphone being clipped onto the sunshade on the vehicle front window.
Figure 4:
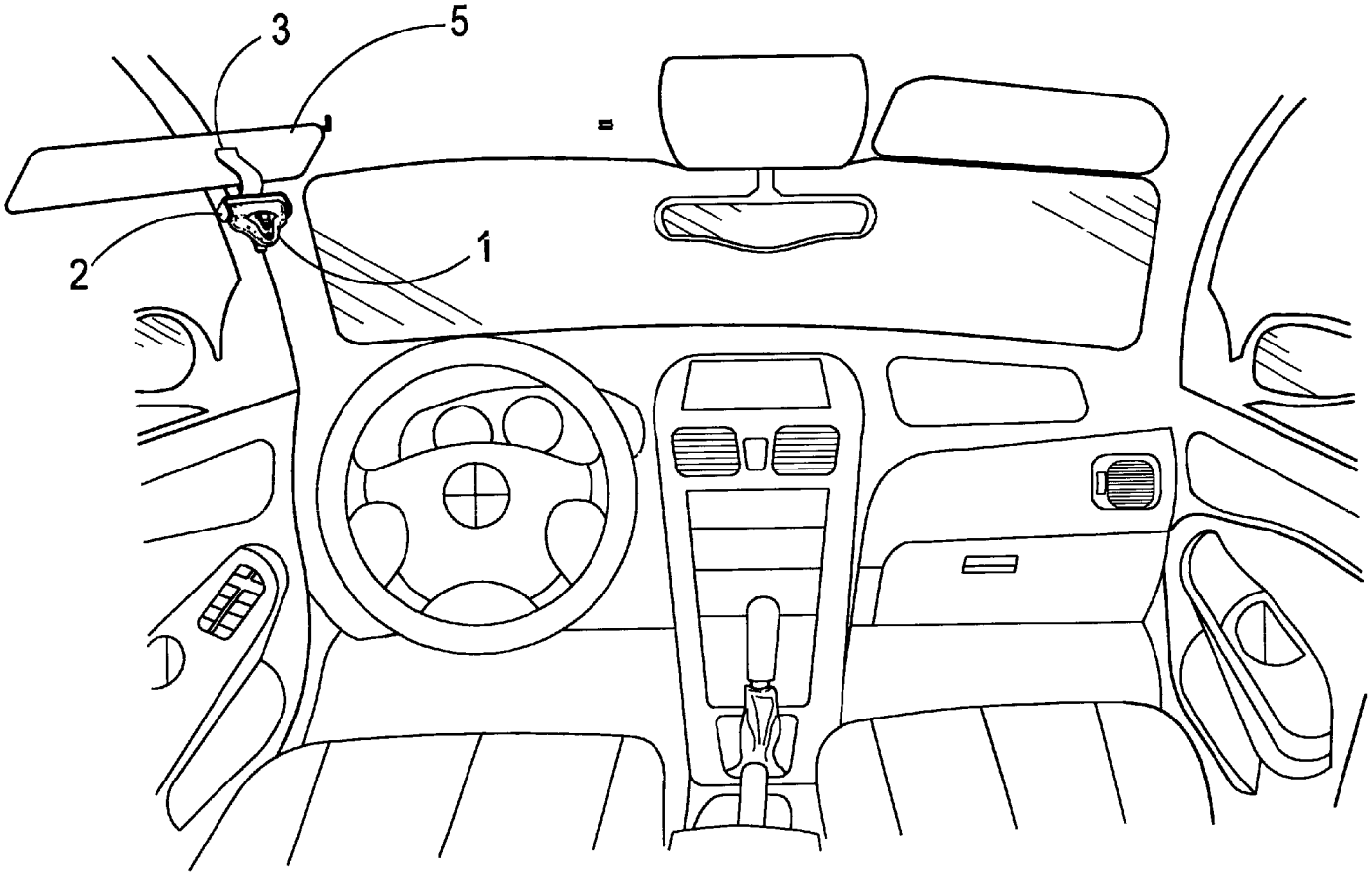
FIG. 4 is a view of the microphone being clipped onto the sunshade on a vehicle side window.

As shown in FIG. 4, when the sunshade is moved from the front window shown in FIG. 3 to the left side to shade the sunlight, it is not necessary to take the microphone main body 1 off the sunshade, but only to adjust the rotatable base 2 and the main body 1 to face a new appropriate direction as both elements are rotatable or turnable.

As the microphone of the present invention is very low power consumption product, rechargeable type AAA batteries are recommendable for saving cost and environmental protection.

It will be well understood from the above description that the exquisitely designed radio microphone of the present invention is really a low cost, handy, and all directionally turnable communication device to be incorporated in a handfree kit for cellular phone for using in a vehicle and is free from the shortcoming inherent to competitive devices.

Those who are skilled in the art will readily perceive how to modify the invention. Therefore, the appended claims are to be construed to cover all equivalent structures which fall within the true scope and spirit of the invention.

What is claimed is:

1. All directionally turnable radio microphone comprising:

a main clip having a containment hole with two opposing trap slots stretched radially out of its circumferential fringe;

a rotatable base with a rotating shaft attached to its center portion and having two elastic straps erected vertically at its both ends thereof and the inner surfaces of both said elastic straps being formed into male protrusions each provided with several notches equidistantly disposed around its circumference, and the front end of said rotating shaft being provided with two radially emerged stoppers; and a microphone main body having a female recess formed at each of its both sides thereof each recess being provided with two inwardly emerged protuberances;

with this construction, said rotating shaft of said rotatable base is inserted into said containment hole of said main clip with said two stoppers trapped in said two trap slots such that said rotating shaft is able to rotate said rotatable base by 360° on said main clip, on the other hand, said microphone main body is conjoined with said rotatable base by said female recesses coupled to said male protrusions such that said main body is secured to said rotational base by the resilient force provided by said two elastic straps of said rotatable base thereby said microphone main body is turnable 180° up and down about an axis connecting the center of said two male protrusions, during turning, said microphone main body can be halt at a position where said protuberances of said female recesses are mated with certain pair of notches formed on said male protrusions thereby the microphone main body is positioned at a desired direction.

2. The microphone of claim 1, wherein said microphone main body is provided with a control board having a push button switch, a microphone and a LED all equipped thereon.

3. The microphone of claim 1, wherein said microphone body has an auxiliary clip.

4. The microphone of claim 1, wherein a round is formed at the front tip of said stopper of said rotating shaft so as to facilitate insertion of said stopper into said trap slot of said containment hole.

* * * * *